US007555804B2

(12) United States Patent
Lin

(10) Patent No.: US 7,555,804 B2
(45) **Date of Patent: *Jul. 7, 2009**

(54) CLEANING HEAD FOR SWEEPING AND WRINGING APPARATUS

(76) Inventor: Ming-Hsien Lin, No. 13, Hun Yi St., Pu Tzi Chen Ind Dist, Chia Yi Hsien (TW)

( * ) Notice: Subject to any disclaimer, the term of this patent is extended or adjusted under 35 U.S.C. 154(b) by 283 days.

This patent is subject to a terminal disclaimer.

(21) Appl. No.: 11/514,046

(22) Filed: Aug. 31, 2006

(65) Prior Publication Data

US 2008/0052851 A1 Mar. 6, 2008

(51) Int. Cl.
*A47L 13/14* (2006.01)
*A47L 13/144* (2006.01)

(52) U.S. Cl. ..... 15/119.2; 15/116.2; 15/244.1

(58) Field of Classification Search ..... 15/119.2, 15/119.1, 244.2, 116.1, 116.2, 147.1, 228
See application file for complete search history.

(56) References Cited

U.S. PATENT DOCUMENTS

| | | | | | |
|---|---|---|---|---|---|
| 1,362,811 | A * | 12/1920 | Mills | 15/146 |
| 3,778,860 | A * | 12/1973 | Thielen | 15/147.2 |
| 4,908,901 | A * | 3/1990 | Torres | 15/119.1 |
| 5,876,141 | A * | 3/1999 | Hsu | 401/207 |
| 5,887,309 | A * | 3/1999 | Lin | 15/119.2 |
| 6,490,749 | B1 * | 12/2002 | Morad | 15/145 |

* cited by examiner

*Primary Examiner*—Dung Van Nguyen
(74) *Attorney, Agent, or Firm*—Pro-Techtor Int'l Services; Ralph Willgohs

(57) ABSTRACT

A cleaning head for a sweeping and wringing apparatus is mounted on a lower end of a connecting rod thereof and comprises a cleaning element, having a sweeping part and a held part, a base plate, holding the held part of said cleaning element and having two fixing elements, which each have a fixing hole and a guiding surface.

18 Claims, 11 Drawing Sheets

CLEANING HEAD FOR SWEEPING AND WRINGING APPARATUS

BACKGROUND OF THE INVENTION

1. Field of the Invention

The present invention relates to a cleaning head for a sweeping and wringing apparatus, particularly to a cleaning head for a sweeping and wringing apparatus which is easily mounted and replaced.

2. Description of Related Art

As shown in FIGS. 10-11, a conventional sweeping and wringing apparatus, as disclosed in U.S. patent application Ser. No. 11/361,099 comprises a cleaning head 1, a squeezing head 2, a main rod 3, a wringing rod 4, a connecting rod 5, two holding elements 56, two squeezers 57, a holding rod 6, and a holding assembly 7. The cleaning head 1 has a base plate 11 and a cleaning element 12 and is used for sweeping a floor. The base plate 11 has in a middle section thereof two fixing elements 15 with fixing holes 17. The squeezing head 2 is placed on an upper side of the cleaning head 1, partly surrounding the cleaning head 1 in the shape of the inverted letter U, and has an upper part, having a fastening hole 21 and downward extending front and rear parts, each of which have a left arm 23 and a right arm 24 further extending downward, enclosing an opening 27. The main rod 3 is mounted on the fastening hole 21 of the squeezing head 2 and has a lower section with a longitudinal elongated hole 31. The wringing rod 4 is on an inner end thereof hingedly connected with the main rod 3 at a middle section thereof and has an outer end with a grip 41. The connecting rod 5 has an upper end that is hingedly connected with the wringing rod 4 and a lower end that passes through the elongated hole 31 of the main rod 3. The two holding elements 56 are fastened at holes 28 in the left and right arms 23, 24. The squeezers 57 are attached to the two holding elements 56. The holding rod 6 is hingedly connected with the lower end of the connecting rod 5. The holding assembly 7 is fastened to a lower end of the holding rod 6 and comprises two fixing elements 66, fastened to the lower end of the holding rod 6 and each having an insertion hole 67, and an elastic insertion assembly 60. The elastic insertion assembly 60 is inserted between the insertion holes 67 and in turn comprises two insertion heads 61 with cross-like shapes and a spring 65. The two insertion heads 61 each have a blocking ring 62, an outer projection 63 and an inner projection 64. When the elastic insertion piece 60 is inserted between the insertion holes 67, the spring 65 is put over the inner projections 64 and the outer projections 63 enter the insertion holes 67.

For replacing the cleaning head 1, the outer projections 63 are pressed on, allowing to remove the cleaning head 1.

While replacing of the cleaning head 1 is thus readily performed, pressing on both outer projections 63 simultaneously is inconvenient.

SUMMARY OF THE INVENTION

An object of the present invention is to provide a cleaning head for a sweeping and wringing apparatus which is easily assembled.

Another object of the present invention is to provide a cleaning head for a sweeping and wringing apparatus which is easily replaced.

The present invention can be more fully understood by reference to the following description and accompanying drawings.

DESCRIPTION OF THE PREFERRED EMBODIMENTS

Figure 10:
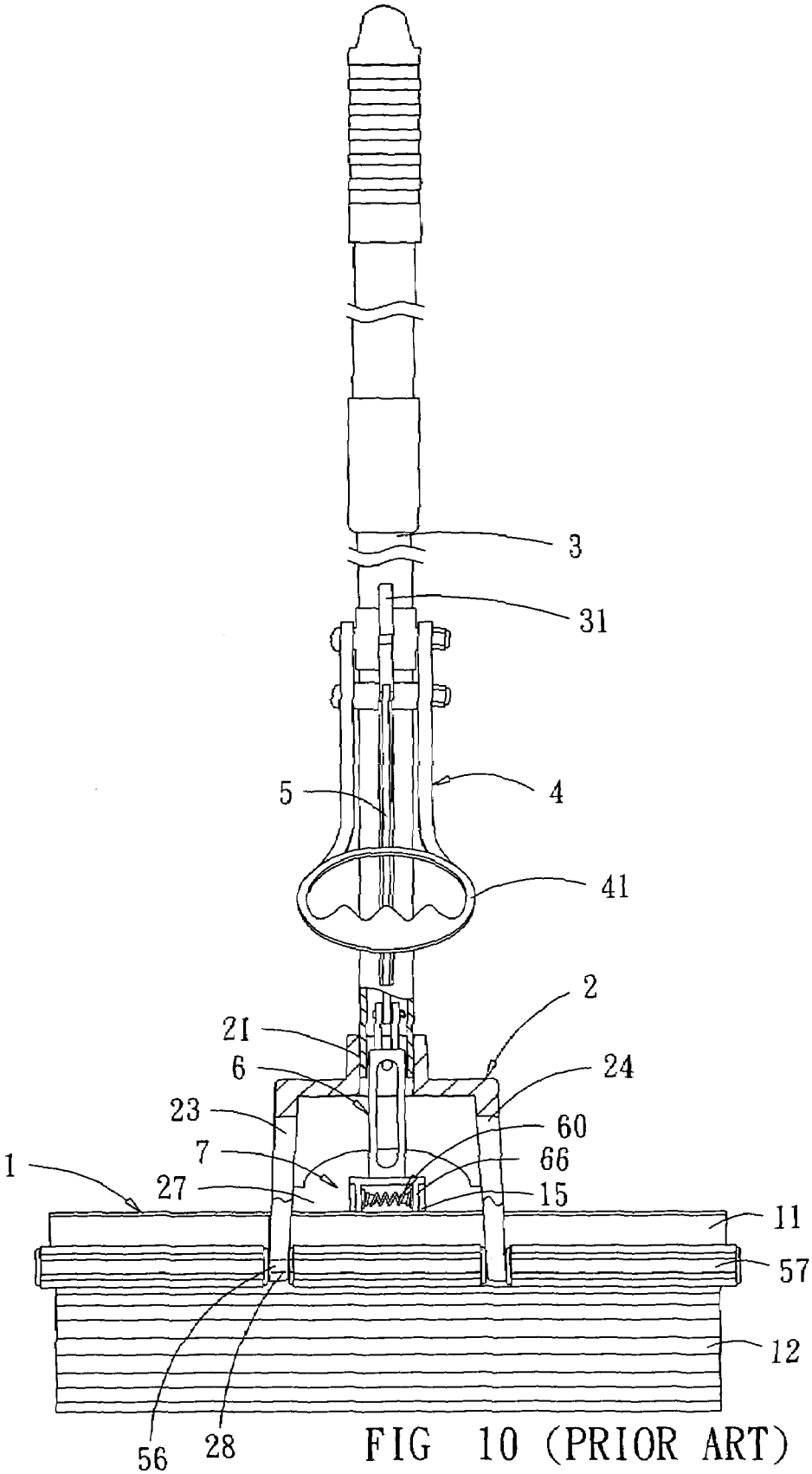
FIG 10 (PRIOR ART)
FIG. 10 (prior art) is a front view of a conventional sweeping and wringing apparatus.
Figure 11:
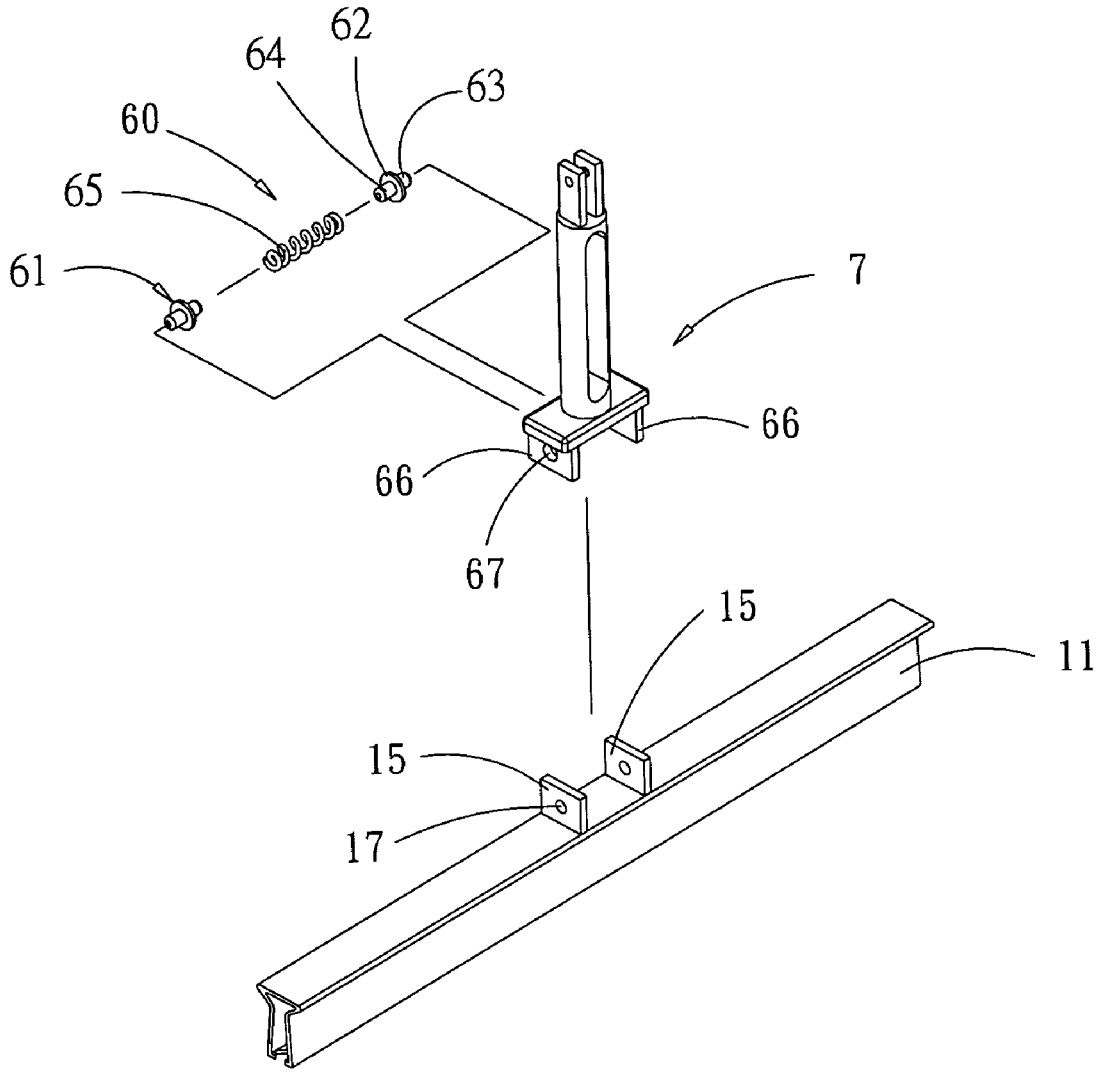
FIG 11 (PRIOR ART)
FIG. 11 (prior art) is an exploded perspective view of a conventional cleaning head for a sweeping and wringing apparatus.

As shown in FIGS. 1-3*c*, the cleaning head of the present invention is used in conjunction with a sweeping and wringing apparatus which comprises structural parts as prior art shown in FIGS. 10 and 11, and in addition thereto comprising a fastening assembly 70, a elastic insertion assembly 8, and a release assembly 9. The fastening assembly 70 is mounted on the lower end of the holding rod 6 and has a chamber 71 enclosed by front and rear walls 72, 74 and left and right walls 73, 75. Openings 761, 762 are cut into the front and rear walls 73, 75 close to left and right edges thereof, and insertion holes 77 are bored into the left and right walls 73, 75. The elastic insertion assembly 8 is inserted between the insertion holes 77 and comprises two insertion heads 81 with cross-like shapes and a first elastic member 82. In one embodiment, two insertion heads 81 each have a blocking piece 83, an outer projection 85 and an inner projection 87. The first elastic member 82, which may be a spring on opposite ends thereof put over the inner projections 87 of the two insertion heads 81. The outer projections 85 reach through the insertion holes 77. The release assembly 9 is mounted in front of the front wall 72 and is shaped like the letter U, having a middle section and two end sections which have chamfered end faces 96. The end sections of the release assembly 9 respectively pass through the openings 761, 762 and respectively reach into spaces between the blocking pieces 83 and the left and right walls 73, 75. An inward projection 93 at the middle section of the release assembly 9 fixes an outer end of a second elastic member, which may be a spring, 95, an inner end of which presses against the front wall 72 of the fastening assembly 70. By the outer projections 85 passing through the insertion holes 77, the cleaning head 1 is held.

Figure 2:
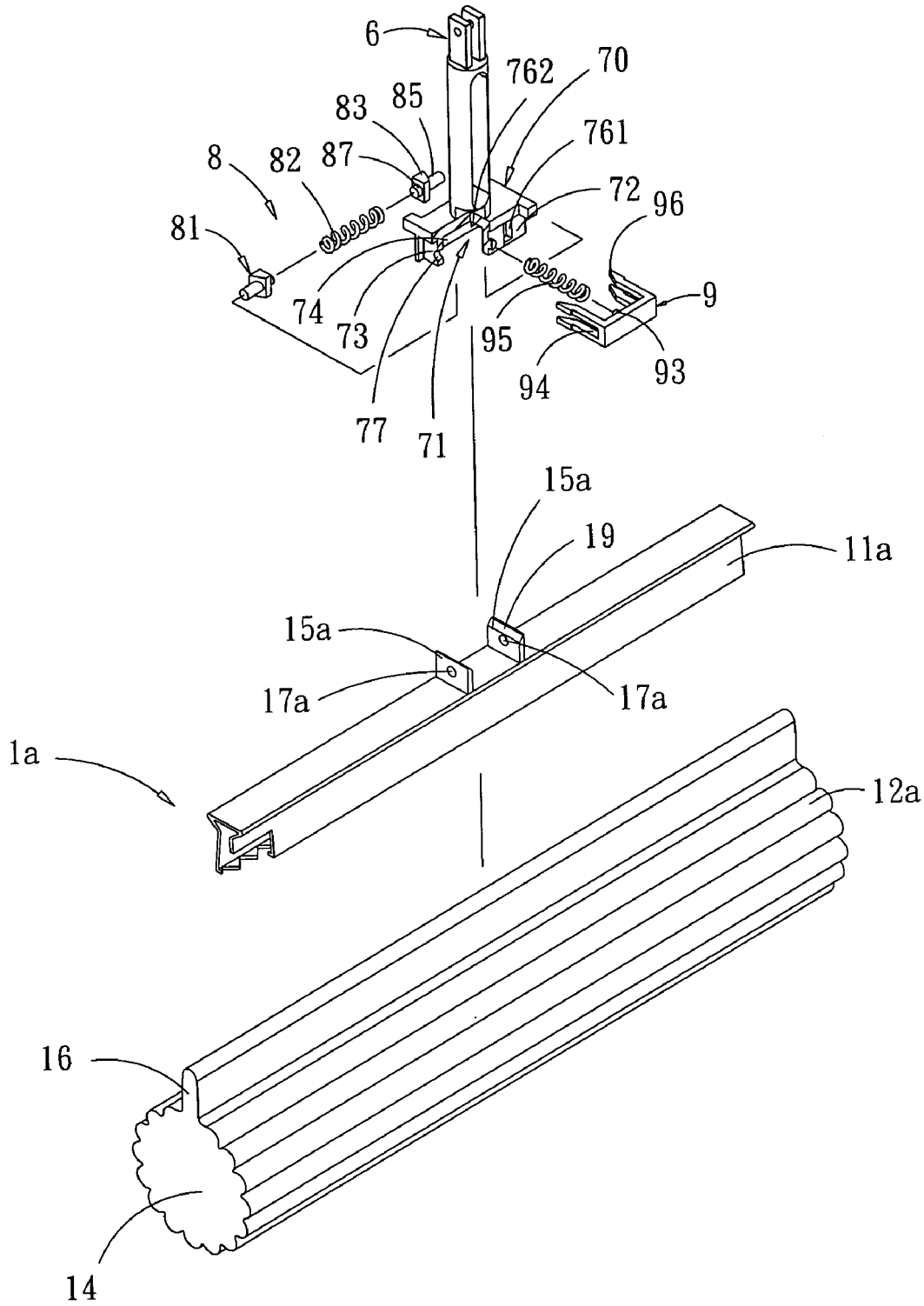
FIG. 2 is an exploded perspective view of the cleaning head of the present invention in conjunction with a holding assembly of a sweeping and wringing apparatus.

The present invention is a cleaning head 1*a* which has structural parts like the cleaning head of conventional art, as shown in FIGS. 2 and 11. The cleaning head 1*a* of the present invention is characterized by two fixing elements 15*a*, which each have a fixing hole 17*a* and have a guiding surface 19. The guiding surfaces 19 are placed at top edges of the fixing elements 15, allowing smoothly to insert the outer projections 85 into the insertion holes 77. Below a detailed description is given.

Figure 1:
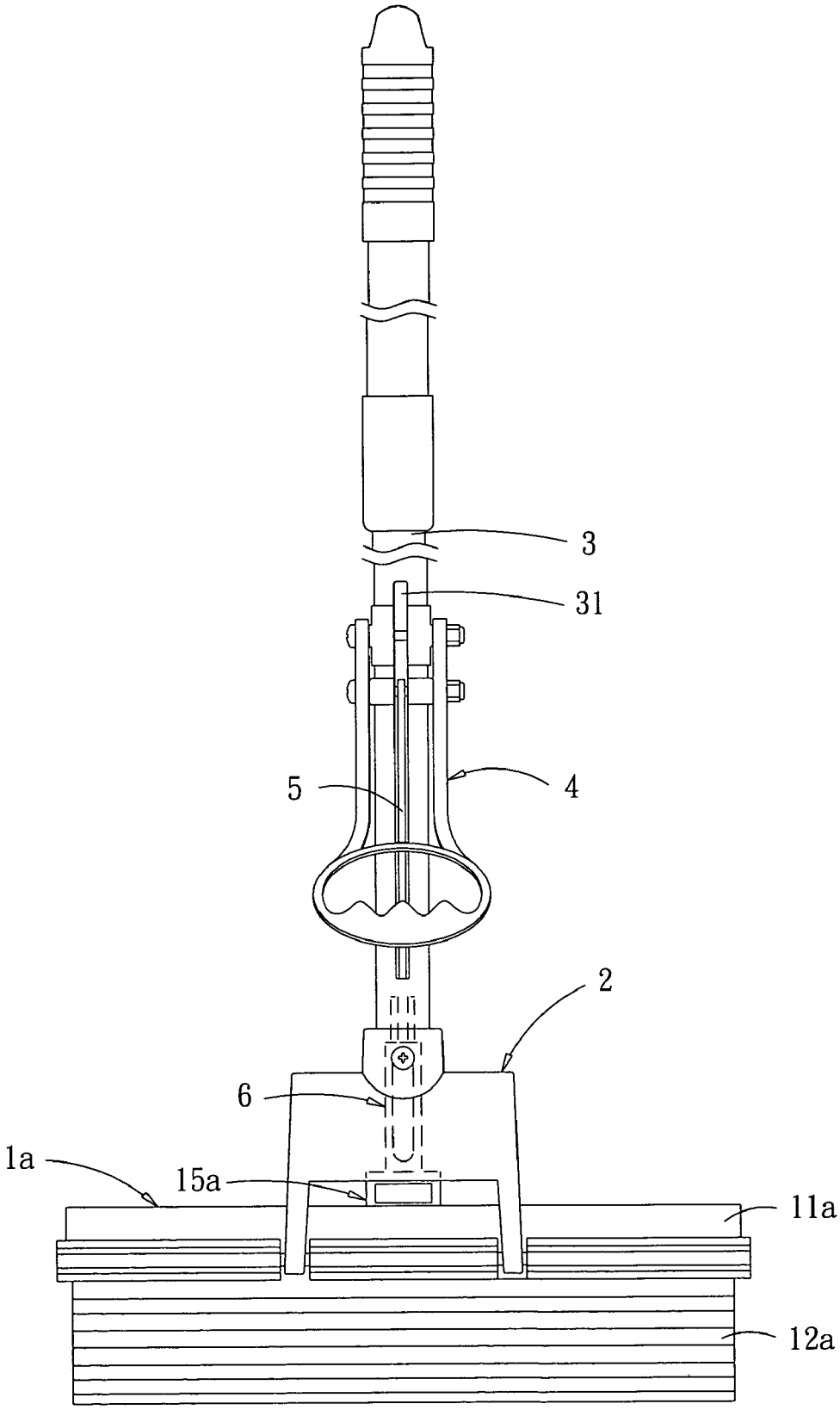
FIG. 1 is a front view of the cleaning head of the present invention in conjunction with a sweeping and wringing apparatus.

Referring to FIGS. 1-2, the cleaning head 1*a* comprises: a cleaning element 12*a* with a sweeping part 14 and a held part 16; a base plate 11*a*, holding the held part 16; and the two fixing elements 15*a*, attached to a middle section of the base plate 11*a*. The two fixing holes 17*a* are bored through the two fixing elements 15*a*, respectively. Each of the guiding surfaces 19 is inclined and placed at an upper edge of one of the fixing elements 15*a*.

Figure 3A:
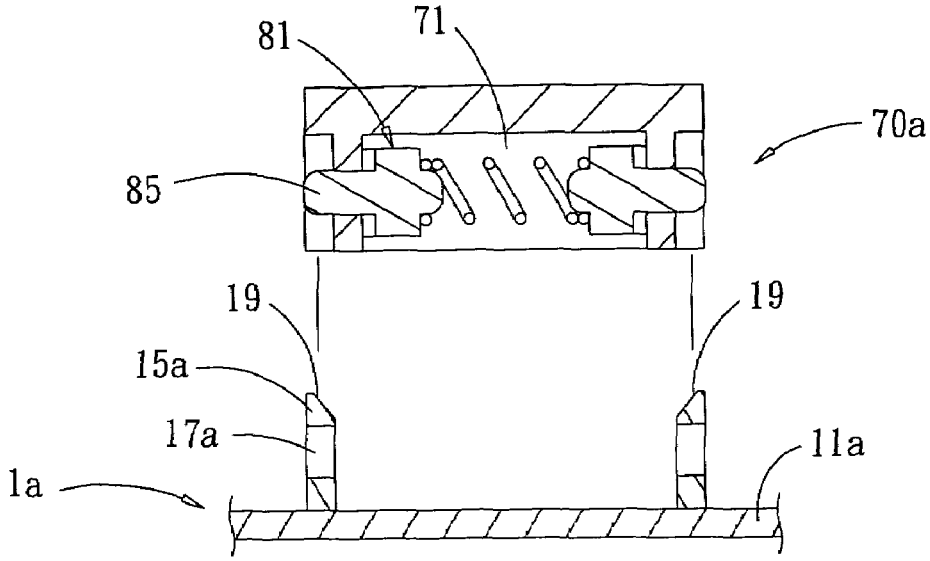
FIGS. 3*a*-3*c* are schematic illustrations of the movements of the present invention when being mounted.
Figure 3B:
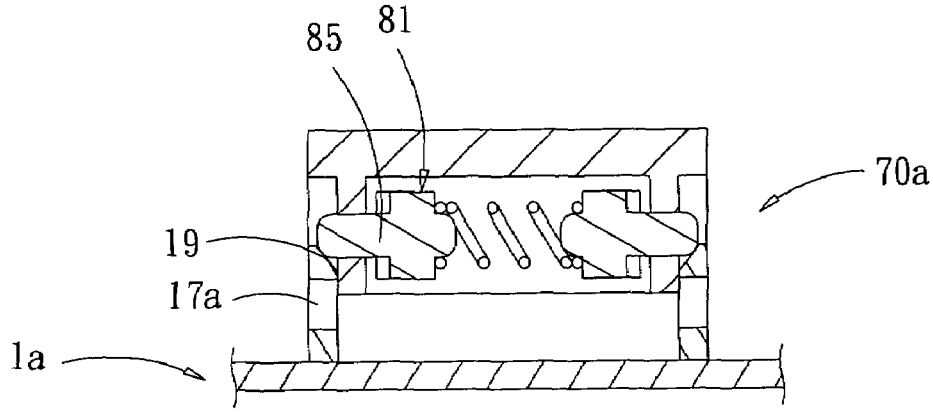
Figure 3C:
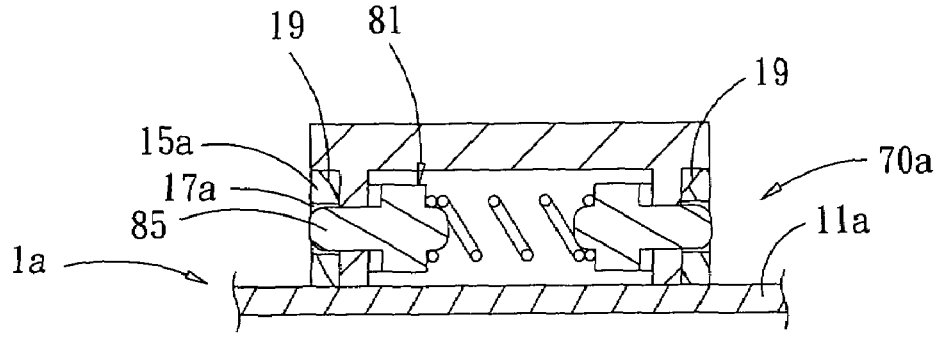

Referring to FIGS. 3*a*-3*c*, when the cleaning head 1*a* is mounted, the guiding surfaces 19 allow smoothly to insert the outer projections 85 into the insertion holes 77 by gradually pressing the insertion heads 81 into the chamber 70, so that the outer projections 85 of the insertion heads 81 will enter the fixing holes 17*a*.

The fixing elements 15*a* and the base plate 11*a* preferably form an integrated body.

Figure 4:
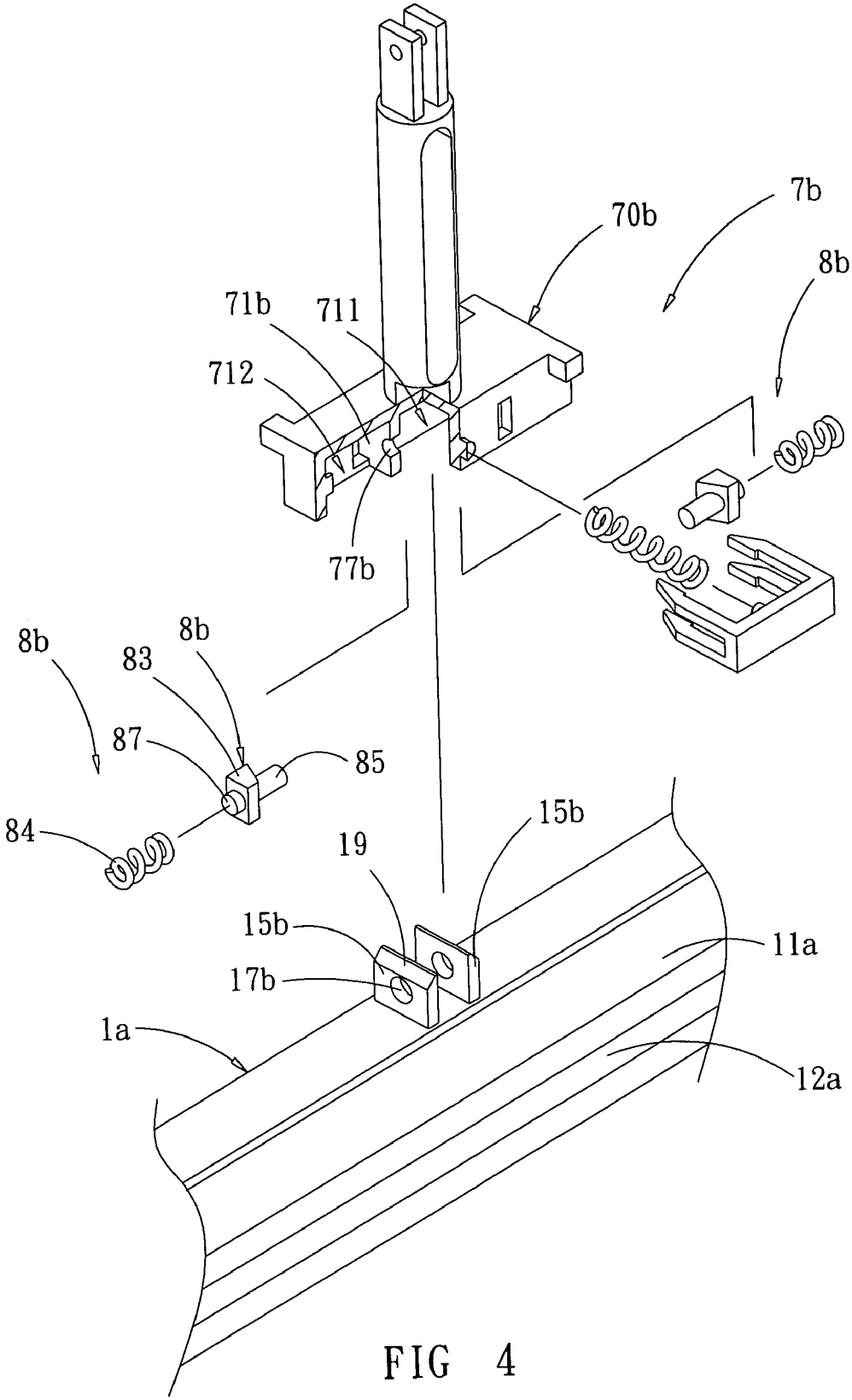
FIG. 4 is an exploded perspective view of the cleaning head of the present invention in the second embodiment.

Referring to FIG. 4, the present invention in a second embodiment is used in conjunction with a fastening assembly 70*b* with two separating walls 71*b*, so that a middle chamber 711 and left and right chambers 712 are formed. Each of the two separating walls 71*b* has an insertion hole 77*b*. Two insertion assemblies 8*b* are placed in the left and right chambers 712, respectively, and each comprise one of the insertion heads 81 with cross-like shapes and a spring 84. The insertion heads 81 each comprise the blocking piece 83, the outer projection 85 and the inner projection 87. For each of the two insertion assemblies 8*b*, the spring 84 is put over the outer projection 85, whereas the inner projection 87 reaches through one of the insertion holes 77*b* to the middle chamber 711. In the second embodiment, the present invention has two fixing elements 15*b* with two fixing holes 17*b* and guiding surfaces 19*b*, which guide the inner projections smoothly to insert the fixing holes 17*b*.

Figure 5A:
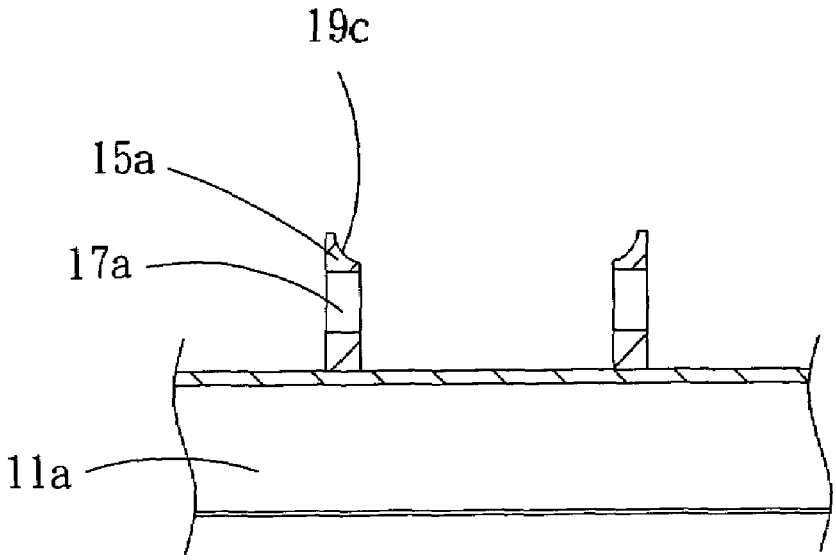
FIGS. 5*a*, 5*b*, 6*a*, 6*b*, 7*a* and 7*b* are sectional views of the present invention in the third to eighth embodiments.
Figure 5B:
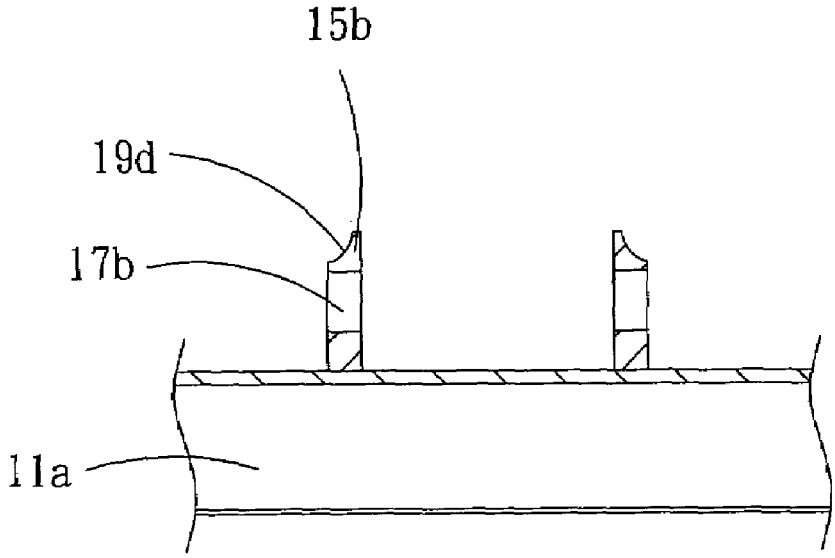

Referring to FIGS. 5*a* and 5*b*, the present invention in third and fourth embodiments has curved guiding surfaces 19*c*, 19*d*.

Figure 6A:
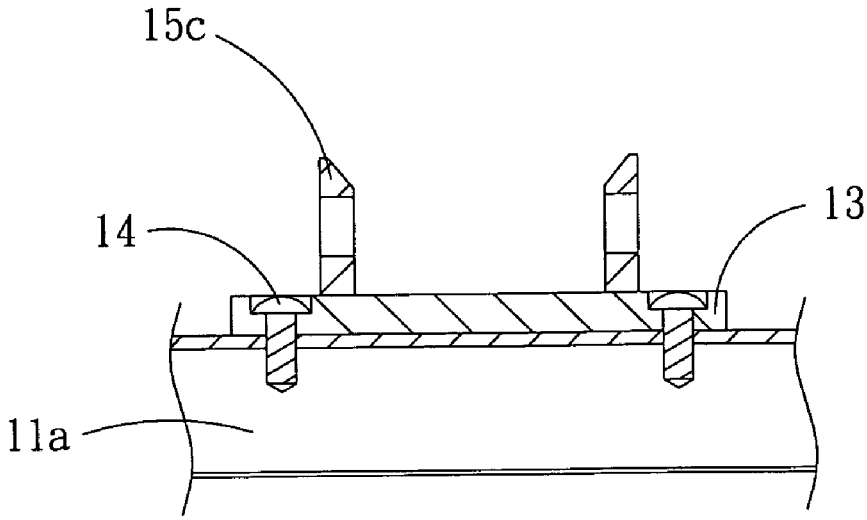
Figure 6B:
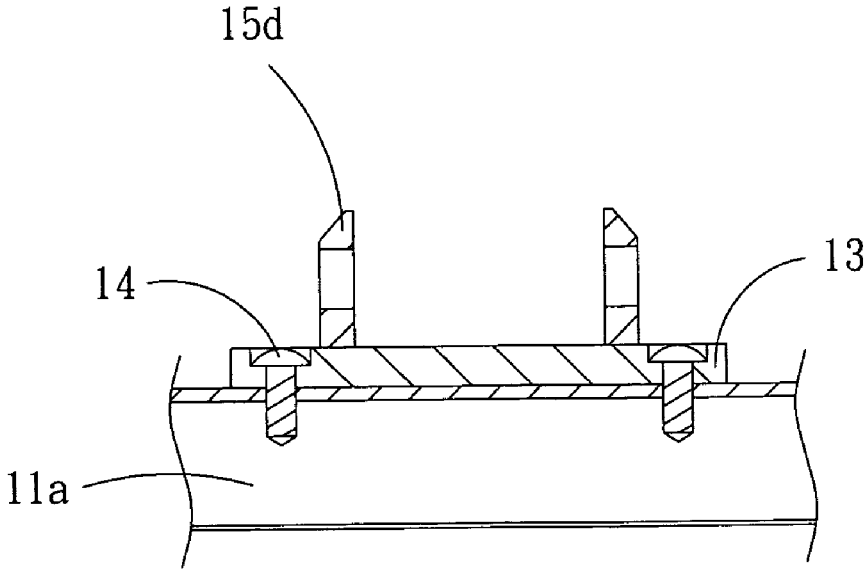

Referring to FIGS. 6*a* and 6*b*, the present invention in fifth and sixth embodiments has fixing elements 15*c*, 15*d* which are carried by a connecting plate 13, with connecting plate 13 being fastened to the base plate 11*a* by bolts 14.

Figure 7A:
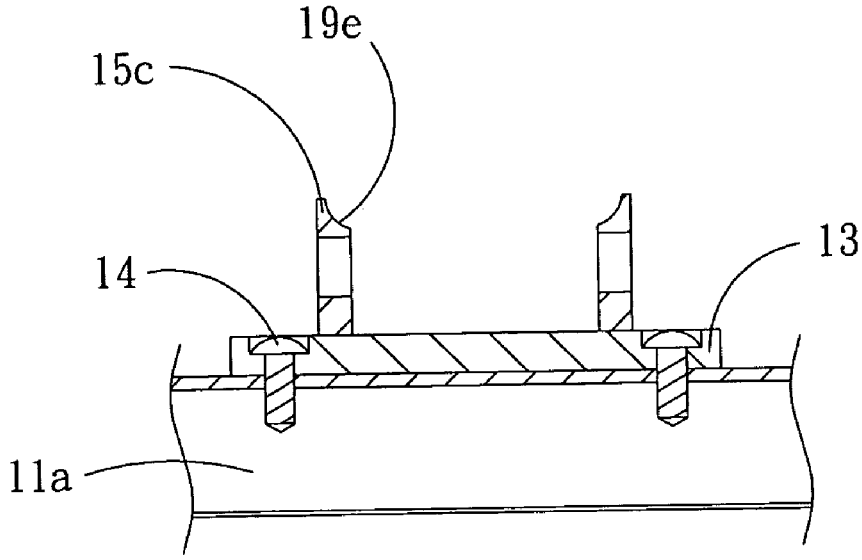
Figure 7B:
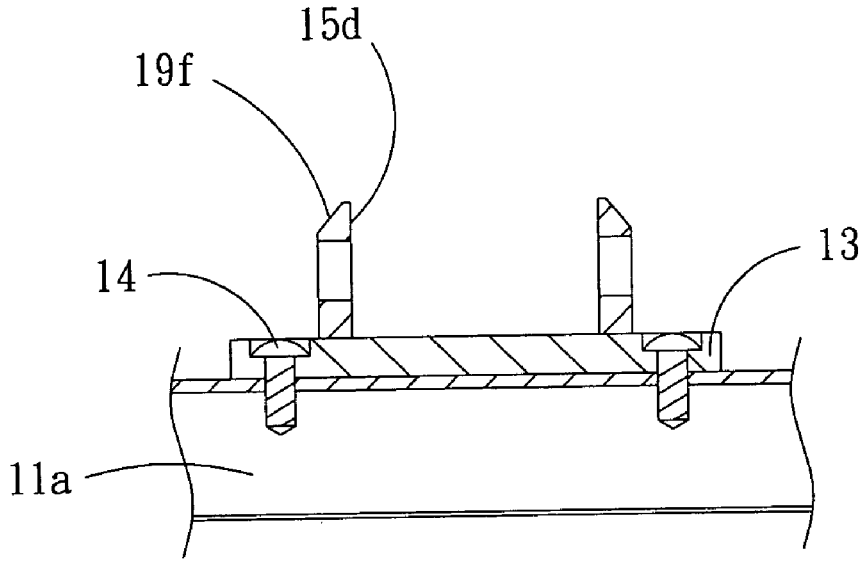

Referring to FIGS. 7*a* and 7*b*, the present invention in seventh and eighth embodiments has curved guiding surfaces 19*e*, 19*f*.

Figure 8A:
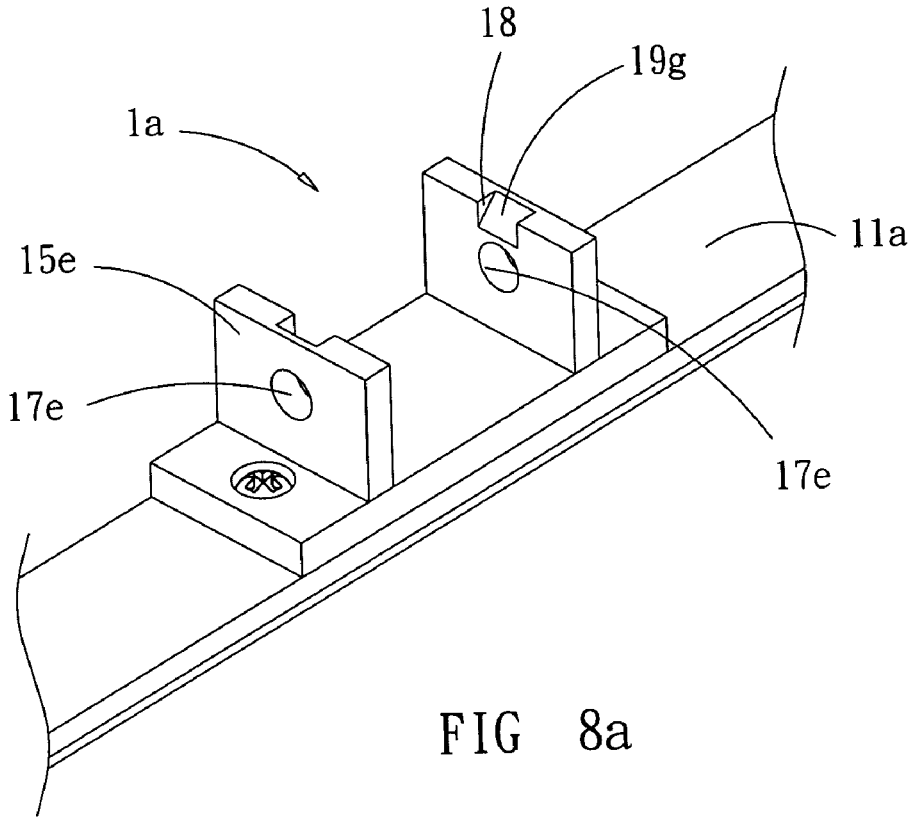
FIGS. 8*a*, 8*b*, 9*a* and 9*b* are perspective views of the present invention in the ninth to twelfth embodiments.
Figure 8B:
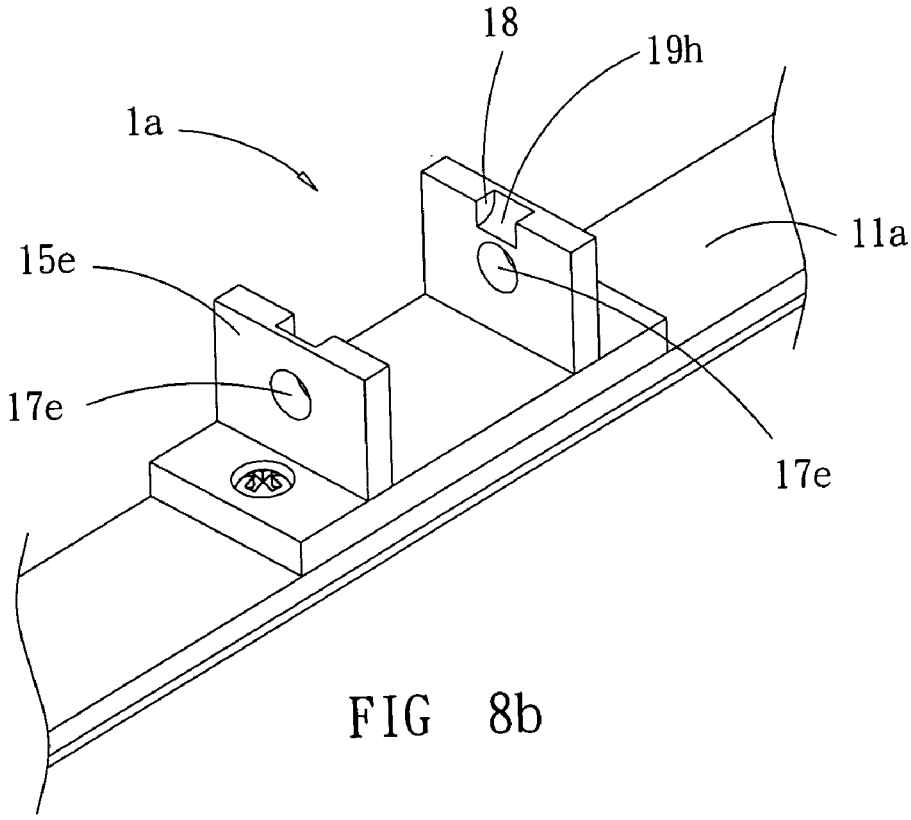

Referring to FIG. 8*a*, for allowing the outer projections 85 smoothly to enter fixing holes 17*e*, the present invention in a ninth embodiment has fixing elements 15*e* with fixing holes 17*e*, with an inner guiding groove 18 cut into each fixing elements 15*e* above the fixing hole thereof 17*e*. Each inner guiding groove 18 has a guiding surface 19*g*. Referring to FIG. 8*b*, the present invention in a tenth embodiment has curved guiding surfaces 19*h*.

Figure 9A:
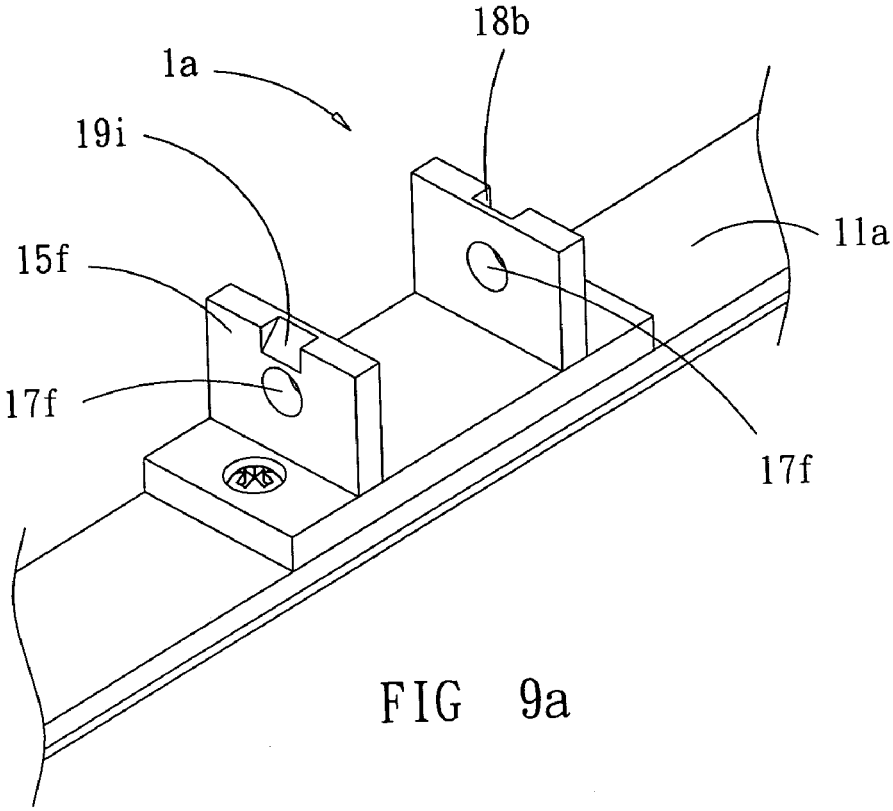
Figure 9B:
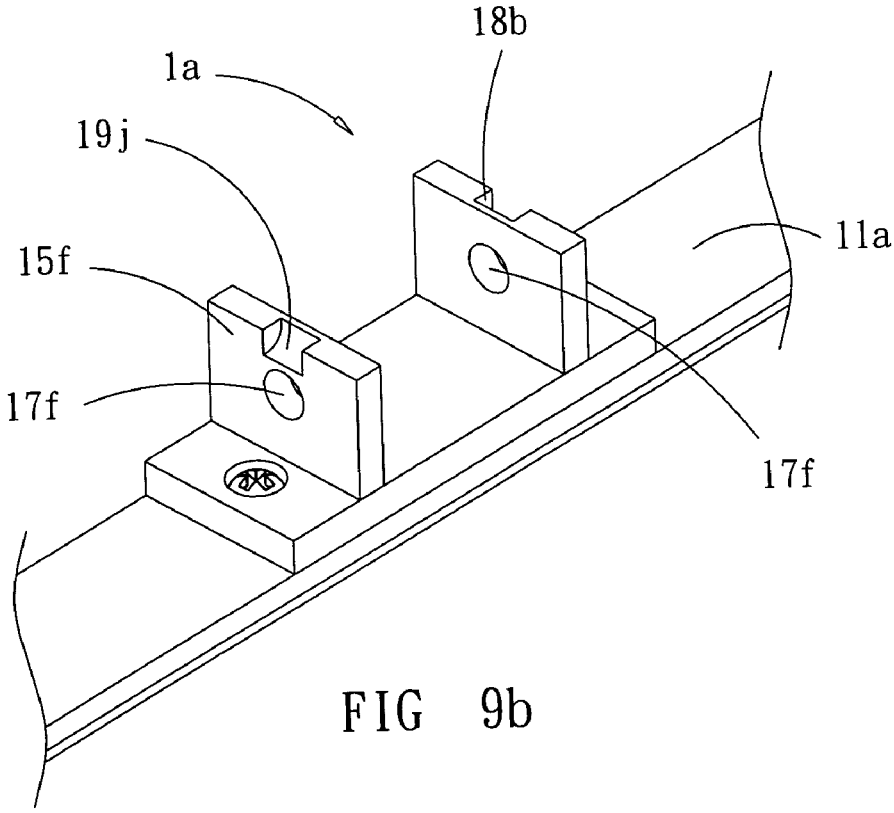

Referring to FIG. 9*a*, for allowing the inner projections 87 smoothly to enter fixing holes 17*f*, the present invention in an eleventh embodiment has fixing elements 15*f* with fixing holes 17*f*, with an outer guiding groove 18*b* cut into each of the fixing elements 15*f* above the fixing hole 17*f* thereof. Each outer guiding groove 18*b* has a guiding surface 19*i*. Referring to FIG. 9*b*, the present invention in a twelfth embodiment has curved guiding surfaces 19*j*.

The invention claimed is:

1. A cleaning head for a sweeping and wringing apparatus, mounted on a lower end of a handle thereof, said cleaning head comprising:

a cleaning element having a sweeping part and a held part;

a base plate, holding said held part of said cleaning element and having two fixing elements, which each have a fixing hole and a guiding surface;

a fastening assembly, fixed to a lower portion of the handle, having an open-bottomed chamber;

an elastic insertion assembly, housed in the chamber of the fastening assembly, and having at least one retractable insertion head, urged by a first elastic member, for engaging a fixing element of the base plate;

a release assembly slideably mounted to a wall of the fastening assembly, having a second elastic member urged against the fastening assembly;

wherein when a user presses the release assembly toward the fastening assembly, the at least one insertion head is retracted, thereby releasing the base plate from the fastening assembly.

2. The cleaning head for a sweeping and wringing apparatus according to claim 1, wherein said two fixing elements are continuous with said base plate to form a single body.

3. The cleaning head for a sweeping and wringing apparatus according to claim 1, wherein said two fixing elements are attached to a connecting plate which is fastened to said base plate by bolts.

4. The cleaning head for a sweeping and wringing apparatus according to claim 1, wherein said guiding surfaces are placed on inner sides of said fixing elements.

5. The cleaning head for a sweeping and wringing apparatus according to claim 4, wherein said guiding surfaces are inclined surfaces.

6. The cleaning head for a sweeping and wringing apparatus according to claim 4, wherein said guiding surfaces are curved surfaces.

7. The cleaning head for a sweeping and wringing apparatus according to claim 1, wherein said guiding surfaces are placed on outer sides of said fixing elements.

8. The cleaning head for a sweeping and wringing apparatus according to claim 7, wherein said guiding surfaces are inclined surfaces.

9. The cleaning head for a sweeping and wringing apparatus according to claim 7, wherein said guiding surfaces are curved surfaces.

10. The cleaning head for a sweeping and wringing apparatus according to claim 1, wherein said fixing elements each have a guiding groove on a top side, with said guiding surfaces being placed on inner sides of said guiding grooves.

11. The cleaning head for a sweeping and wringing apparatus according to claim 10, wherein said guiding surfaces are inclined surfaces.

12. The cleaning head for a sweeping and wringing apparatus according to claim 10, wherein said guiding surfaces are curved surfaces.

13. The cleaning head for a sweeping and wringing apparatus according to claim 1, wherein said fixing elements each have a guiding groove on a top side, with said guiding surfaces being placed on outer sides of said guiding grooves.

14. The cleaning head for a sweeping and wringing apparatus according to claim 13, wherein said guiding surfaces are inclined surfaces.

15. The cleaning head for a sweeping and wringing apparatus according to claim 13, wherein said guiding surfaces are curved surfaces.

16. A cleaning head for a sweeping and wringing apparatus, mounted on a lower end of a handle thereof, said cleaning head comprising:

a cleaning element having a sweeping part and a held part;

a base plate, holding said held part of said cleaning element and having two fixing elements, which each have a fixing hole and a guiding surface;

a holding rod fastened to a lower portion of the handle;

a fastening assembly fixed to a lower end of the holding rod, having an open-bottomed chamber with openings cut into a front wall and a rear wall, and insertion holes through a left wall and a right wall aligned with the fixing holes of the base plate;

an elastic insertion assembly having two retractable insertion heads separated by a first elastic member, and inserted in compression between the insertion holes, each insertion head having an outer projection extending through the insertion holes to releaseably engage with the fixing holes of the base plate;

a U-shaped release assembly slideably mounted to the front wall of the fastening assembly, having end sections extending into the chamber through the holes in the front wall, and a middle section with a retainer fixing an outer end of a second elastic member in compression with the inner end supported against the front wall and substantially orthogonal to the first elastic member;

wherein when a user presses the middle section of the release assembly toward the front wall, the end sections engage the insertion heads causing the outer projections to be retracted, thereby releasing the base plate from the fastening assembly.

17. The cleaning head for a sweeping and wringing apparatus according to claim 16, wherein said end sections of the release assembly have chamfered end faces.

18. The cleaning head for a sweeping and wringing apparatus according to claim 17, wherein said insertion heads each have a blocking piece and an inner projection for retaining the first elastic member.

* * * * *